United States Patent [19]

Dickinson et al.

[11] 4,012,230

[45] Mar. 15, 1977

[54] TUNGSTEN-NICKEL-COBALT ALLOY AND METHOD OF PRODUCING SAME

[75] Inventors: James M. Dickinson; Robert E. Riley, both of Los Alamos, N. Mex.

[73] Assignee: The United States of America as represented by the United States Energy Research and Development Administration, Washington, D.C.

[22] Filed: July 7, 1975

[21] Appl. No.: 593,356

[52] U.S. Cl. ..... 75/212; 75/200; 75/221; 75/224; 75/227; 29/182

[51] Int. Cl.[2] ..... C22C 1/04; B22F 3/16

[58] Field of Search ..... 75/176, 212, 221, 214, 75/224, 200, 227; 29/182

[56] References Cited

UNITED STATES PATENTS

| | | | |
|---|---|---|---|
| 2,793,951 | 5/1957 | Green | 75/214 |
| 2,860,972 | 11/1958 | Fraser | 75/176 |
| 2,986,465 | 5/1961 | Kurtz | 75/212 |
| 3,015,560 | 1/1962 | Thurber | 75/212 X |
| 3,116,146 | 12/1963 | Gatti | 75/176 X |
| 3,254,955 | 6/1966 | Goodfellow et al. | 75/176 |
| 3,359,082 | 12/1967 | Dickinson et al. | 75/207 X |
| 3,368,879 | 2/1968 | Krock et al. | 75/212 X |
| 3,407,061 | 10/1968 | Hutkin | 75/212 X |
| 3,577,227 | 5/1971 | Davies | 29/182 |
| 3,638,293 | 2/1972 | Peterson | 75/176 X |

OTHER PUBLICATIONS

Kabayama, Sukeaki et al. Chem. Abs. 73:71322z [Japan patent 70–14,658] 1970.

*Primary Examiner*—Richard E. Schafer
*Attorney, Agent, or Firm*—Dean E. Carlson; Paul D. Gaetjens

[57] ABSTRACT

An improved tungsten alloy having a tungsten content of approximately 95 weight percent, a nickel content of about 3 weight percent, and the balance being cobalt of about 2 weight percent is described. A method for producing said tungsten-nickel-cobalt alloy is further described and comprises (a) coating the tungsten particles with a nickel-cobalt alloy, (b) pressing the coated particles into a compact shape, (c) heating said compact in hydrogen to a temperature in the range of 1400° C and holding at this elevated temperature for a period of about 2 hours, (d) increasing this elevated temperature to about 1500° C and holding for 1 hour at this temperature, (e) cooling to about 1200° C and replacing the hydrogen atmosphere with an inert argon atmosphere while maintaining this elevated temperature for a period of about ½ hour, and (f) cooling the resulting alloy to room temperature in this argon atmosphere.

1 Claim, No Drawings

TUNGSTEN-NICKEL-COBALT ALLOY AND METHOD OF PRODUCING SAME

BACKGROUND OF THE INVENTION

1. Field of the Invention

This invention relates to an improved tungsten alloy and particularly to a tungsten alloy having a content of about 95 weight percent tungsten, 3 weight percent nickel, and 2 weight percent cobalt. Also described is a method of making this alloy.

2. Prior Art

The inventors believe that the alloy range and composition is both novel and has advantages over any alloys of the prior art. To the inventors' knowledge the only art concerning composition of high density tungsten alloys involves U.S. Pat. No. 2,793,951 entitled "Powder Metallurgical Process for Producing Dense Tungsten Alloys," inventors, Green et al., and U.S. Pat. No. 3,254,995 entitled "Heavy Metal Alloys," inventors, Goodfellow et al. These patents are directed to a teaching of tungsten-nickel-iron-cobalt alloys which have characteristics that are similar to the characteristics of the alloy of this invention. In particular, U.S. Pat. No. 2,793,951 discloses an alloy with a composition range containing from 80 to 96% by weight of tungsten and 4 to 20% by weight of nickel plus iron. Their preferred range of composition consists of 80 to 90% tungsten and/or molybdenum and 4 to 20% iron plus nickel in any proportions, by weight. U.S. Pat. No. 3,254,995 also discloses a high tungsten alloy, and in particular, said alloy contains between 80 to 99.9% tungsten, preferably 90 to 99.5% tungsten, with the remaining percentages being nickel and iron in equal proportions. This patent further discloses that cobalt may be used effectively in amounts up to about one percent of the total weight of the alloy, and higher amounts of cobalt may be added if desired. A still further teaching of this invention is that the iron may be partially replaced by cobalt. The nickel can also be partially replaced by cobalt.

The method of making the alloy of this invention has not been described to the inventors' knowledge in any publication or patent. The inventors wish to call the Examiner's attention, however, to the following patent which they believe represents the most closely related art: U.S. Pat. No. 3,577,227 entitled "Tungsten Materials and a Method for Providing Such Materials," inventor, Gail F. Davies. This patent discloses a method for shaping and forming metallic tungsten by coating tungsten particles with a minor amount of metallic rhenium and thereafter compacting and partially sintering said coated particles. The patent further discloses a method for providing intricate shapes of high temperature resistant, nonductile tungsten by resintering said compacted and sintered rhenium-coated tungsten particles at a temperature sufficient to diffuse the metallic rhenium into the tungsten. In particular, this method compacts and sinters the rhenium-coated tungsten particles at a temperature between 900° and 1200° C to diffuse the rhenium into the tungsten body, and resintering the coated tungsten body at a temperature between 1400° and 2000° C.

SUMMARY OF THE INVENTION

This invention relates to a dense tungsten-nickel-cobalt alloy wherein the tungsten content is about 95 weight percent and the nickel and cobalt comprise the balance. This invention also provides a method of producing said tungsten-nickel-cobalt alloy which includes the following steps: (a) coating the tungsten particles with a nickel-cobalt alloy, (b) pressing the coated particles into a compact shape, (c) heating said compact in hydrogen to a temperature in the range of 1200° to 1400° C, and holding at this elevated temperature for a period of 2 hours, (d) increasing the temperature to a range of 1300° C to 1530° C and holding at this elevated temperature for a period of 1 hour, (e) cooling to a temperature of about 1200° C, and replacing the hydrogen atmosphere with an inert argon atmosphere and holding at this temperature for a period of ½ hour, and (f) cooling the alloy to room temperature while maintaining this argon atmosphere.

DESCRIPTION OF THE PREFERRED EMBODIMENT

A coating consisting of an alloy of nickel-cobalt containing from 60 to 75 weight percent nickel is applied to tungsten particles by an electroless method using either sodium hypophosphite or dimethyl borane solutions as the reducing agent. The phosphite bath leaves a considerable amount of phosphorus in the alloy; consequently, the borane bath is to be preferred. Coatings ranging from 2.5 to 10 weight percent of the tungsten have been used. When used, the iron binder ranges from 30 to 60 weight percent of the nickel-cobalt alloy coating on the tungsten. The alloy is prepared by blending the coated particles and then isostatically pressing the powders at 50,000 psi for about 20 minutes. The pressed powders are then sintered by heating in $H_2$ to 1200 to 1400° C, holding 120 minutes and heating to the sintering temperature, which may range from 1300° to 1530° C, and holding 60 minutes. The furnace is cooled to 1200° C and held at temperature for at least 30 minutes after the $H_2$ atmosphere has been replaced with argon. The alloys are then cooled to room temperature in argon atmosphere. Properties of the alloy can be varied by the heat treatment used.

Tungsten powders ranging in size from 0.8 to 10 $\mu$m have been used. The best results have been obtained with particles around 5 $\mu$m in size. Alloys in the composition range of 95 to 97 weight percent tungsten have been produced. A considerable increase in hardness occurs in these alloys at lower sintering temperatures and a very fine grain size (0.008 mm) can be formed. The alloys can show high strengths and can have good ductilities.

What we claim is:

1. A method of producing a dense tungsten-nickel-cobalt alloy which comprises (a) coating tungsten particles with a nickel-cobalt alloy, (b) pressing the coated particles into a coherent compact shape, (c) heating said compact in a hydrogen atmosphere to a temperature in the range of 1200° C to 1400° C and maintaining this temperature for a period of about 2 hours, (d) increasing the temperature to a range of 1300° C to 1530° C and holding at this elevated temperature for a period of about one hour, (e) cooling to a temperature of about 1200° C, replacing the hydrogen atmosphere with an inert argon atmosphere while maintaining 1200° C temperature for a period of about ½ hour, and (f) cooling the tungsten-nickel-cobalt alloy compact to room temperature while maintaining this argon atmosphere.

* * * * *